US009835988B2

(12) United States Patent
Ebe et al.

(10) Patent No.: US 9,835,988 B2
(45) Date of Patent: Dec. 5, 2017

(54) ELECTRO-PHOTOGRAPHY IMAGE FORMING APPARATUS

(71) Applicant: Oki Data Corporation, Tokyo (JP)

(72) Inventors: Takaaki Ebe, Tokyo (JP); Toshiyuki Totsuka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/235,246

(22) Filed: Aug. 12, 2016

(65) Prior Publication Data

US 2017/0075262 A1 Mar. 16, 2017

(30) Foreign Application Priority Data

Sep. 10, 2015 (JP) ..... 2015-178631

(51) Int. Cl.
*G03G 15/16* (2006.01)
*G03G 15/00* (2006.01)

(52) U.S. Cl.
CPC ..... *G03G 15/1665* (2013.01); *G03G 15/5058* (2013.01); *G03G 2215/00455* (2013.01)

(58) Field of Classification Search
CPC ..... G03G 15/1665; G03G 15/5058
USPC ..... 399/121, 384
See application file for complete search history.

(56) References Cited

U.S. PATENT DOCUMENTS

| | | | | |
|---|---|---|---|---|
| 5,105,227 | A | 4/1992 | Kitamura et al. | |
| 8,515,310 | B2 * | 8/2013 | Nakura et al. ..... | G03G 15/0131 399/121 |
| 8,811,834 | B2 * | 8/2014 | Yoshida ..... | G03G 15/5058 399/121 |
| 2004/0218944 | A1 | 11/2004 | Kawaguchi et al. | |

FOREIGN PATENT DOCUMENTS

| | | | |
|---|---|---|---|
| JP | H0485461 | U | 7/1992 |
| JP | 2000181320 | A | 6/2000 |
| JP | 2003076153 | A | 3/2003 |
| JP | 2015025920 | A | 2/2015 |

OTHER PUBLICATIONS

Search Report dated Feb. 17, 2017 in EP Application No. 16183509.5.

* cited by examiner

*Primary Examiner* — William J Royer
(74) *Attorney, Agent, or Firm* — Panitch Schwarze Belisario & Nadel LLP

(57) ABSTRACT

An image forming apparatus includes an image forming section, a transferred member, a transfer roller, and a separator. The image forming section forms a developer image. The transferred member is conveyed in a first direction and the developer image is to be transferred on the transferred member. The transfer roller faces the transferred member, and makes a transition between a biasing state in which the transferred member is biased by the transfer roller and a separated state in which the transfer roller is separated away from the transferred member. The separator starts to separate a medium away from the transferred member after the transfer roller starts making a transition from the biasing state to the separated state, the medium being held between the transferred member and the transfer roller in the biasing state.

12 Claims, 13 Drawing Sheets

ELECTRO-PHOTOGRAPHY IMAGE FORMING APPARATUS

CROSS REFERENCE TO RELATED APPLICATIONS

This application claims the benefit of Japanese Priority Patent Application JP 2015-178631 filed on Sep. 10, 2015, the entire contents of which are incorporated herein by reference.

BACKGROUND

The invention relates to an image forming apparatus that uses an electro-photography method to form an image.

There is proposed an image forming apparatus that includes a displacement controller of a transferring member or transfer roller, as disclosed in Japanese Unexamined Patent Application Publication No. 2015-25920, for example. The displacement controller of the transfer roller moves an endless image holding body (a transferred member) that holds an image on a surface thereof and a transfer roller that transfers the image to continuous sheet, in a direction in which the image holding body and the transfer roller are brought into contact with each other and separated away from each other relatively.

SUMMARY

In an image forming apparatus, it is desirable that a correction operation for formation of a developer image on a transferred member, such as print density correction and color deviation correction be performable even in a state in which continuous paper is located between the transferred member and a transfer roller.

It is desirable to provide an image forming apparatus that makes it possible to form an image with better quality.

An image forming apparatus according to an illustrative embodiment of the invention includes: an image forming section that forms a developer image; a transferred member conveyed in a first direction and onto which the developer image is to be transferred; a transfer roller that faces the transferred member, and makes a transition between a biasing state in which the transferred member is biased by the transfer roller and a separated state in which the transfer roller is separated away from the transferred member; and a separator that separates, in the separated state, a medium away from the transferred member, in which the medium is held between the transferred member and the transfer roller in the biasing state.

An image forming apparatus according to an illustrative embodiment of the invention includes: an image forming section that forms a developer image; a transferred member conveyed in a first direction and onto which the developer image is to be transferred; a transfer roller that faces the transferred member, and makes a transition between a biasing state in which the transferred member is biased by the transfer roller and a separated state in which the transfer roller is separated away from the transferred member; a support that supports the transfer roller; and a separator that separates, in the separated state, a medium away from the transferred member, in which the medium is held between the transferred member and the transfer roller in the biasing state. The separator includes a driver, a cam, and a biasing member. The cam pivots, by driving force transmitted from the driver, in one of a first pivoting direction and a second pivoting direction that is opposite to the first pivoting direction. The biasing member biases, by the pivot of the cam in the second pivoting direction, the medium in a direction in which the medium is separated away from the transferred member. The support brings the transfer roller close to the transferred member by the pivot of the cam in the first pivoting direction, or separates the transfer roller away from the transferred member by the pivot of the cam in the second pivoting direction. The separator starts to separate the medium away from the transferred member after the transfer roller starts making a transition from the biasing state to the separated state.

DETAILED DESCRIPTION

In the following, some example embodiments of the invention are described in detail with reference to the accompanying drawings. Note that the following description is directed to illustrative examples of the invention and not to be construed as limiting to the invention. Also, factors such as arrangement, dimensions, and a dimensional ratio of elements illustrated in each drawing are illustrative only and not to be construed as limiting to the invention. The description is given in the following order.

1. First Embodiment

An image forming apparatus having a configuration in which a support of a transfer roller and a retaining member of a medium are integrated.

2. Modification of First Embodiment

An image forming apparatus in which a retaining member of a medium is provided downstream of a secondary transferring section.

3. Second Embodiment

An image forming apparatus having a configuration in which a support of a transfer roller and a retaining member of a medium are formed separately from each other.

4. Modification of Second Embodiment

An image forming apparatus in which a retaining member of a medium is provided in an intermediate transferring unit.

5. Other Modifications

[1. First Embodiment]

[Outline Configuration]

Figure 1:
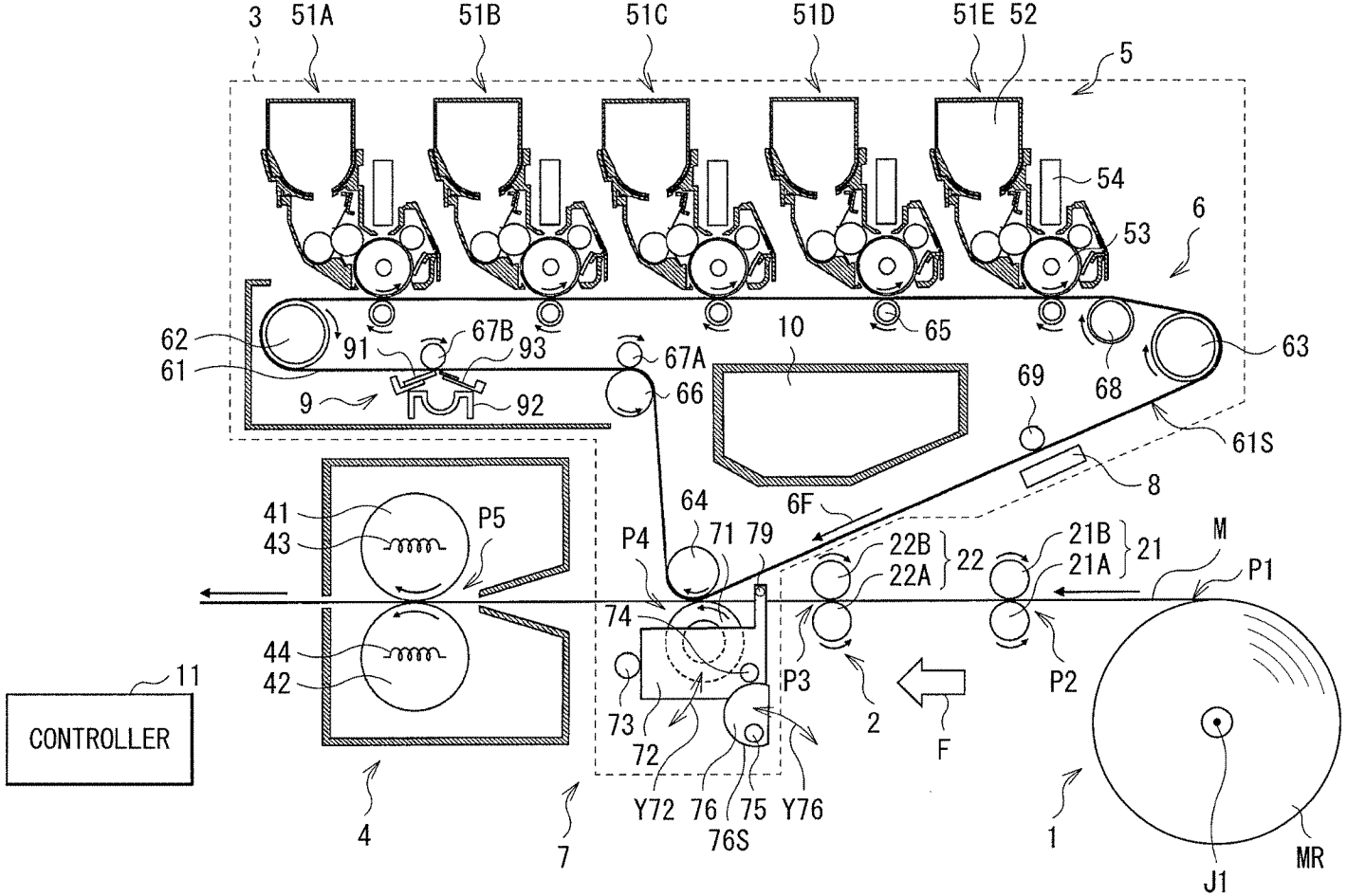
FIG. 1 is a schematic diagram illustrating, upon printing operation, an overall configuration example of an image forming apparatus according to a first embodiment of the invention.

FIG. 1 is a schematic diagram illustrating, upon printing operation, an overall configuration example of an image forming apparatus according to a first embodiment of the invention. An image forming unit may be an electro-photographic printer that forms an image (for example, a color image) on a medium (also referred to as paper, a recording medium, a print medium, or a transferred medium) M.

As illustrated in FIG. 1, the image forming apparatus may include, for example, a medium feeding section 1, a medium conveying section 2, an image forming section 3, and a fixing section 4 in order from upstream to downstream. The image forming apparatus further includes a controller 11 that controls entire operation of the image forming apparatus, including an operation of each of the medium feeding section 1, the medium conveying section 2, the image forming section 3, and the fixing section 4. The medium M that is fed from the medium feeding section 1 may be conveyed in order of the medium conveying section 2, the image forming section 3, and the fixing section 4. Note that, in a direction (an arrow F) in which the medium M travels, a position close to the medium feeding section 1 that is a feed source of the medium M as viewed from any position is referred to herein as upstream, and a position far from the medium feeding section 1 is referred to herein as downstream. Further, a direction that is orthogonal to the traveling direction (the arrow F) of the medium M (a direction perpendicular to the paper surface of FIG. 1) is referred to herein as a lateral direction. The image forming section 3 corresponds to a specific but non-limiting example of an "image forming section" in one embodiment of the invention.

The medium feeding section 1 rotatably holds a roll (a wound structure) MR with a shaft J1 as a rotation axis, and feeds the medium M toward the downstream medium conveying section 2 upon printing operation. The roll MR may be the wound medium M on which image formation is to be performed. A feed position at which the medium M is fed out from the roll MR is defined as P1.

The medium conveying section 2 includes a roller pair 21 and a roller pair 22 that are disposed in order from upstream to downstream. The roller pair 21 includes a roller 21A and a roller 21B that face each other at a position P2. The roller pair 22 includes a roller 22A and a roller 22B that face each other at a position P3. The medium M that has been fed out from the roll MR passes through the position P2 and the position P3 in order. The feed position P1 of the medium M, the position P2, and the position P3 may be preferably arranged in a straight line in order to suppress load to be applied to the medium M.

The image forming section 3 includes an image forming unit 5, an intermediate transfer unit 6, a secondary transfer roller unit 7, a sensor group 8, a cleaning unit 9, and a waste toner collecting container 10.

The image forming unit 5 includes developing devices 51 (51A to 51E) that are disposed above the intermediate transfer unit 6, and each develop a toner (a developer) of corresponding color to form a toner image (a developer image). The image forming unit 5 forms toner images of the respective colors in an electrophotography method on a transferred surface 61S of an intermediate transfer belt 61 (described later) of the intermediate transfer unit 6. Each of the developing devices 51 may include, for example, a toner feeding section 52, a photosensitive drum 53, and an exposure section 54.

The intermediate transfer unit 6 may include, for example, the intermediate transfer belt 61, a drive roller 62, a tension roller 63, a secondary transfer backup roller 64, a primary transfer roller 65, a reverse bending roller 66, support rollers 67A and 67B, and idle rollers 68 and 69. The intermediate transfer belt 61 may be an endless elastic belt that is made of, for example, a resin material such as a polyimide resin, and corresponds to a specific but non-limiting example of a "transferred member" in one embodiment of the invention. The intermediate transfer belt 61 may be stretched by and stretched around the drive roller 62, the tension roller 63, the secondary transfer backup roller 64, the primary transfer roller 65, the reverse bending roller 66, the support rollers 67A and 67B, the idle rollers 68 and 69, and other members. The intermediate transfer belt 61 may be stretched to allow the transferred surface 61S, on which the toner image is to be transferred by means of a primary transfer, to face outside, for example. The drive roller 62 may be a member that is rotatably driven by a drive motor, thereby causing the intermediate transfer belt 61 to rotate in a predetermined conveying direction 6F. The tension roller 63 may be a driven roller that follows the rotation of the intermediate transfer belt 61, and applies tensile force to the intermediate transfer belt 61 by means of biasing force applied from a biasing member such as a coil spring. The secondary transfer backup roller 64 may be disposed to face a secondary transfer roller 71 (described later) at a position P4, and hold, together with the secondary transfer roller 71, the intermediate transfer belt 61 and the medium M to thereby form a secondary transferring section upon printing operation. The secondary transfer backup roller 64 and the secondary transfer roller 71 perform, to the medium M, a secondary transfer of the toner image that has been transferred by means of the primary transfer to a surface of the intermediate transfer belt 61. The primary transfer roller 65 may be disposed to hold, together with the photosensitive drum 53 of each developing device 51, the intermediate transfer belt 61 to thereby form a primary transferring section. The primary transfer roller 65 applies a predetermined voltage when performing, to the surface of the intermediate transfer belt 61, the primary transfer of the toner image that has been formed by corresponding developing device 51. The reverse bending roller 66 bends the intermediate transfer belt 61 to secure space in which the fixing section 4 is disposed. The support roller 67A may be disposed to face the reverse bending roller 66 and hold, together with the reverse bending roller 66, the intermediate transfer belt 61. The support roller 67B may be disposed to face the cleaning unit 9, and hold, together with a blade 91 (described later) of the cleaning unit 9, the intermediate transfer belt 61. The support roller 67B stabilizes a nip between the intermediate transfer belt 61 and the blade 91. Each of these support rollers 67A and 67B may be a driven roller that follows the rotation of the intermediate transfer belt 61, and maintains stable traveling of the intermediate transfer belt 61. The idle roller 68 may be disposed between the tension roller 63 and the primary transfer roller 65 that faces the photosensitive drum 53 of the developing device 51 located on the most downstream side. The idle roller 68 maintains the intermediate transfer belt 61 to be horizontal which has just passed through the primary transferring section. The idle roller 69 may be disposed to face the sensor group 8 with the intermediate transfer belt 61 in between, and maintains a fixed distance between the sensor group 8 and the intermediate transfer belt 61.

The secondary transfer roller unit 7 includes: the secondary transfer roller 71; a support 72 that rotatably supports the secondary transfer roller 71; shaft members 73 to 75 that extend in the lateral direction; and an eccentric cam 76 that is fixed to both ends of the shaft member 75. The secondary transfer roller 71 corresponds to a specific but non-limiting example of a "transfer roller" in one embodiment of the invention. A detailed configuration of the secondary transfer roller unit 7 is described later.

The sensor group 8 may include, for example, a color deviation sensor and a density sensor. The color deviation sensor detects relative positional deviation, namely, color deviation in the conveying direction 6F of the toner images of the respective colors that have been formed by the developing devices 51 and then transferred by means of the primary transfer to the transferred surface 61S of the intermediate transfer belt 61. The color deviation sensor may include, for example, a light emitting diode that applies light to the transferred surface 61S of the intermediate transfer belt 61, and a light receiver that receives light reflected by the transferred surface 61S, such as a phototransistor and a photodiode. Also, the density sensor detects density of each of the toner images that are formed by the respective developing devices 51, and may be disposed to face the transferred surface 61S of the intermediate transfer belt 61.

The cleaning unit 9 includes the blade 91, a waste toner container 92, and a film 93. The blade 91 scrapes remaining toners that remain on the transferred surface 61S of the intermediate transfer belt 61. The waste toner container 92 contains the remaining toners that have been scraped by the blade 91 once, and has a conveying device such as a conveying spiral that conveys the waste toner to the waste toner collecting container 10. The film 93 prevents the waste toners that have been scraped once by the blade 91, from being thrown up.

The waste toner collecting container 10 may be a member that is disposed inside a space surrounded by the intermediate transfer belt 61, for example, and contains the waste toner that remains on the surface of the intermediate transfer belt 61 after the secondary transfer.

The fixing section 4 may be disposed downstream of the secondary transferring section in which the secondary transfer backup roller 64 and the secondary transfer roller 71 face each other. The fixing section 4 applies heat and pressure to the toner images that have been transferred to the medium M conveyed from the secondary transferring section, and allows the toner images to melt, thereby fixing the melted toner images on the medium M. The fixing section 4 includes paired rollers 41 and 42, a heat source 43, and a heat source 44. The paired rollers 41 and 42 may be brought into press contact with each other at a predetermined pressure at a position P5. The heat source 43 may be installed in the roller 41 and heat the roller 41. The heat source 44 may be installed in the roller 42 and heat the roller 42. The heat sources 43 and 44 may be, for example, halogen lamps. The paired rollers 41 and 42 may be operable to perform an approaching operation in which the paired rollers 41 and 42 come close to and come into contact with each other, and a separating operation in which the paired rollers 41 and 42 move in a direction in which they are separated from each other. The fixing section 4 conveys the medium M to the downstream side while holding the medium M between the roller 41 and the roller 42 and applying heat and pressure to the medium M. Note that the separating operation that causes the paired rollers 41 and 42 to be separated away from each other may be carried out, for example, in a case where malfunction occurs in traveling of the medium M, in a case where a correction operation such as print density correction and color deviation correction is performed, upon standby in which the printing operation is not performed, or in any other occasion. In this case, the position P3 of the roller pair 22, the position P4 of the secondary transferring section, and the position P5 of the fixing section 4 may be desirably arranged in a straight line. This prevents traveling of the medium M from becoming unstable depending on a kind of the medium M, and makes it easier to ensure formation of favorable toner images.

[Detailed Configuration of Secondary Transfer Roller Unit 7]

Figure 2:
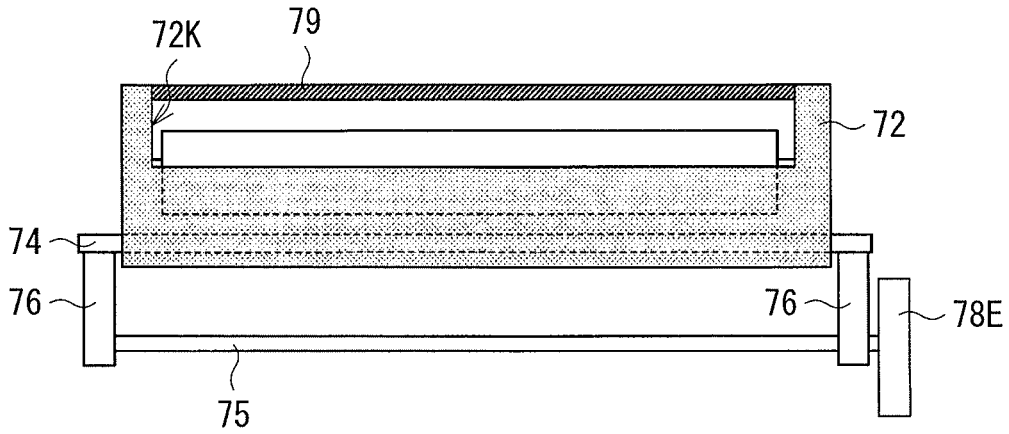
FIG. 2 is a side view of a configuration example of a secondary transfer roller unit illustrated in FIG. 1, as viewed from the upstream side thereof.
Figure 3:
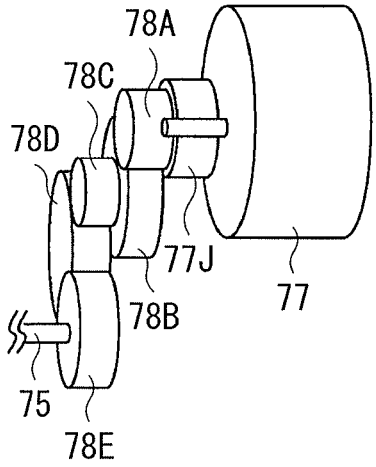
FIG. 3 is an outline perspective view of a drive transmission mechanism for pivot operation of an eccentric cam illustrated in FIG. 1.

The detailed configuration of the secondary transfer roller unit 7 is described with reference to FIG. 2 and FIG. 3. FIG. 2 is a side view of the configuration of the secondary transfer roller unit 7 as viewed from the upstream side thereof. FIG. 3 is an outline perspective view of a drive transmission mechanism for pivot operation of the eccentric cam 76.

The secondary transfer roller 71 holds, together with the secondary transfer backup roller 64, the intermediate transfer belt 61 and the medium M to thereby form the secondary transferring section. The secondary transfer roller 71 rotates along with traveling of the intermediate transfer belt 61 and the medium M, and causes positional difference between the secondary transfer roller 71 and the secondary transfer backup roller 64, thereby performing, to the medium M, the secondary transfer of the toner images that have been transferred by means of the primary transfer to the transferred surface 61S.

The support 72 rotatably supports both ends of the secondary transfer roller 71. The support 72 corresponds to a specific but non-limiting example of a "support" in one embodiment of the invention. The support 72 may be fixed to the rod-shaped shaft member 73 that extends in the lateral direction along the secondary transfer roller 71, and pivot within a range illustrated by an arrow Y72 (FIG. 1) with the shaft member 73 as a supporting point. The shaft member 74 penetrates through the support 72 in the lateral direction, and may be fixed to the support 72 to allow both ends thereof to protrude from the support 72. A peripheral surface of the shaft member 74 comes into contact with a peripheral surface 76S of the eccentric cam 76, and slides on the peripheral surface 76S of the eccentric cam 76 along with the pivot of the eccentric cam 76. Two eccentric cams 76 may be preferably provided such that respective eccentric cams 76 come into contact with both ends of the shaft member 74 (FIG. 2). The eccentric cam 76 may be fixed to the shaft member 75, and may be pivotable within a range illustrated by an arrow Y76 (FIG. 1) around the shaft member 75.

Figure 4:
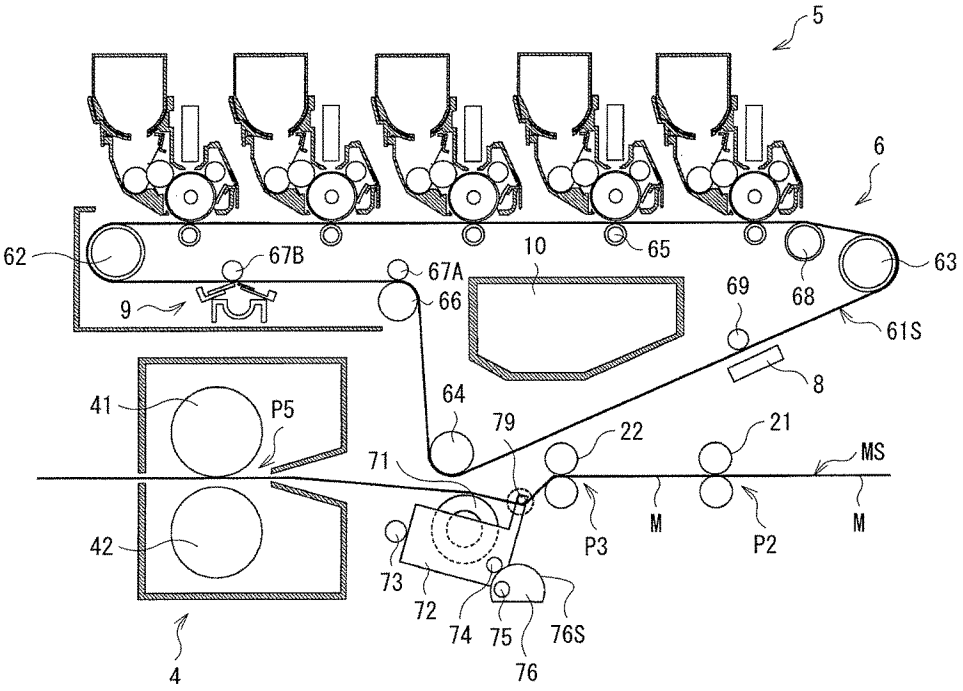
FIG. 4 is a schematic diagram illustrating, upon standby, an overall configuration example of the image forming apparatus illustrated in FIG. 1.

The shaft member 74 slides on the peripheral surface 76S of the eccentric cam 76 along with such pivot of the eccentric cam 76, which changes attitude of the support 72. For example, upon the printing operation illustrated in FIG. 1, a part that is located relatively far from the shaft member 75, of the peripheral surface 76S of the eccentric cam 76 may come into contact with the shaft member 74, and the support 72 may accordingly be pushed up to a relatively high position. This state corresponds to a specific but non-limiting example of a "biasing state" in one embodiment of the invention, in which the secondary transfer roller 71 supported by the support 72 biases the intermediate transfer belt 61 toward the secondary transfer backup roller 64. In contrast, for example, upon standby illustrated in FIG. 4, the eccentric cam 76 may be moved to a position that is rotated rightward by, for example, 90 degrees from the position of FIG. 1. Thus, a part that is located relatively close to the shaft member 75, of the peripheral surface 76S of the eccentric cam 76 may come into contact with the shaft member 74, and the support 72 may accordingly be dropped down to a low position relatively. This state corresponds to a specific but non-limiting example of a "separated state" in one embodiment of the invention, in which the secondary transfer roller 71 supported by the support 72 is separated away from the intermediate transfer belt 61. Note that, in this example, the support 72 falls freely by own weight due to change in the pivot position of the eccentric cam 76 that is supported by the support 72. Alternatively, a biasing member such as a spring may be used to actively push the support 72 downward. Such a change in attitude change of the support 72 allows the secondary transfer roller 71 supported by the support 72 to perform the approaching operation in which the secondary transfer roller 71 approaches toward the intermediate transfer belt 61 and the separating operation in which the secondary transfer roller 71 is separated away from the intermediate transfer belt 61. In other words, the secondary transfer roller 71 may be operable to make a transition between the biasing state and the separated state. The separating operation that causes the secondary transfer roller 71 to be separated away from the intermediate transfer belt 61 may be carried out, for example, in the case where malfunction occurs in traveling of the medium M, in the case where a correction operation such as print density correction and color deviation correction is performed, upon standby in which the printing operation is not performed, or in any other occasion.

As illustrated in FIG. 3, the secondary transfer roller unit 7 further includes a motor 77 serving as a driving source that generates driving force, and gears 78A to 78E that transmit the driving force to the shaft member 75. The motor 77 corresponds to a specific but non-limiting example of a "driver" in one embodiment of the invention. The motor 77 may be provided with a shaft 77J, and the driving force may be transmitted to the gear 78A through rotation of the shaft 77J. The gear 78A engages with the gear 78B, the gear 78B engages with the gear 78C, the gear 78C engages with the gear 78D, the gear 78D engages with the gear 78E, and the gear 78E may be fixed to an end of the shaft member 75. Thus, when the motor 77 is driven and the shaft 77J rotates, the gears 78A to 78E and the shaft member 75 rotate in conjunction with one another, and the eccentric cam 76 accordingly pivots around the shaft member 75. The pivoting of the eccentric cam 76 by means of the driving force of the motor 77 causes the eccentric cam 76 itself to bias the support 72 and bring the secondary transfer roller 71 close to the intermediate transfer belt 61. At this time, adjusting a rotation amount of the motor 77 makes it possible to appropriately change the pivot position of the eccentric cam 76, namely, attitude of the support 72.

The support 72 further includes a retaining member 79 at an upper part thereof. The retaining member 79 corresponds to a specific but non-limiting example of a "biasing member" in one embodiment of the invention. Further, a combination of the retaining member 79 and the motor 77 corresponds to a specific but non-limiting example of a "separator" in one embodiment of the invention. The retaining member 79 forms an opening 72K together with the support 72. Upon the printing operation illustrated in FIG. 1, the retaining member 79 may be located between the second roller pair 22 and the secondary transferring section, and the medium M traveling toward the secondary transferring section passes through the opening 72K. At this time, it is preferable that the retaining member 79 be prevented from coming into contact with the medium M (be separated away from the medium M). In contrast, upon standby illustrated in FIG. 4, since the retaining member 79 is also moved downward together with the support 72, the retaining member 79 may be in contact with an upper surface MS of the medium M at the upstream side of the secondary transferring section, and push down the medium M. In other words, the retaining member 79 that is fixed to the support 72 biases the medium M in a direction away from the intermediate transfer belt 61. Therefore, a separating operation in which the medium M is separated and the separating operation of the secondary transfer roller 71 may be carried out in conjunction with each other by means of the movement of the retaining member 79 and the support 72, namely, by means of the change in attitude of the support 72, thereby causing both the secondary transfer roller 71 and the medium M to be separated away from the intermediate transfer belt 61. It is to be noted that, in the biasing state, the secondary transfer roller 71 is in contact with the intermediate transfer belt 61 with the medium M in between whereas the retaining member 79 is separated away from the medium M. In the biasing state, the secondary transfer roller 71 may be separated away from the intermediate transfer belt 61 at timing different from timing at which the medium M may be separated away from the intermediate transfer belt 61. In detail, at the time immediately after the support 72 starts to change its attitude (to move downward in FIG. 4), the holding state of the medium M by the secondary transfer roller 71 and the intermediate transfer belt 61 may be released but the biasing operation of the retaining member 79 with respect to the medium M has not been started. This is due to a gap provided between the retaining member 79 and the medium M, and a predetermined time is thus necessary for the retaining member 79 to come close to and come into contact with the medium M. In other words, when the retaining member 79 is to be separated from the medium M in the biasing state, the retaining member 79 starts to separate the medium M away from the intermediate transfer belt 61 after the secondary transfer roller 71 starts making a transition from the biasing state to the separated state.

[Workings and Effects]

[Basic Operation]

Figure 5:
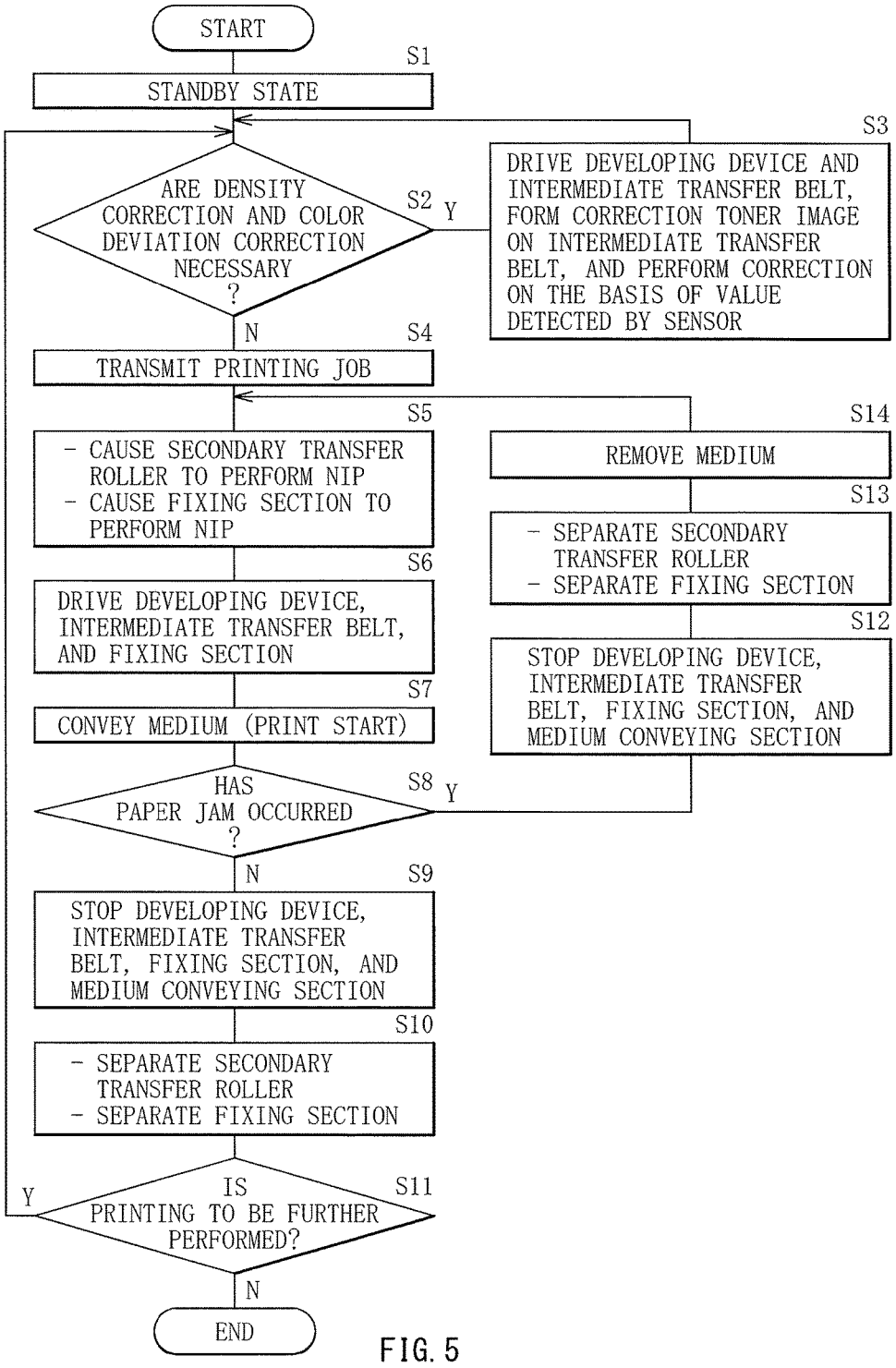
FIG. 5 is a flowchart for describing operation of the image forming apparatus illustrated in FIG. 1.

In the image forming apparatus, the toner images may be transferred to the medium M in the following manner. An operation of the image forming apparatus according to the first embodiment is described below with reference to FIG. 5. FIG. 5 is a flowchart for describing the operation of the image forming apparatus according to the first embodiment.

Figure 6:
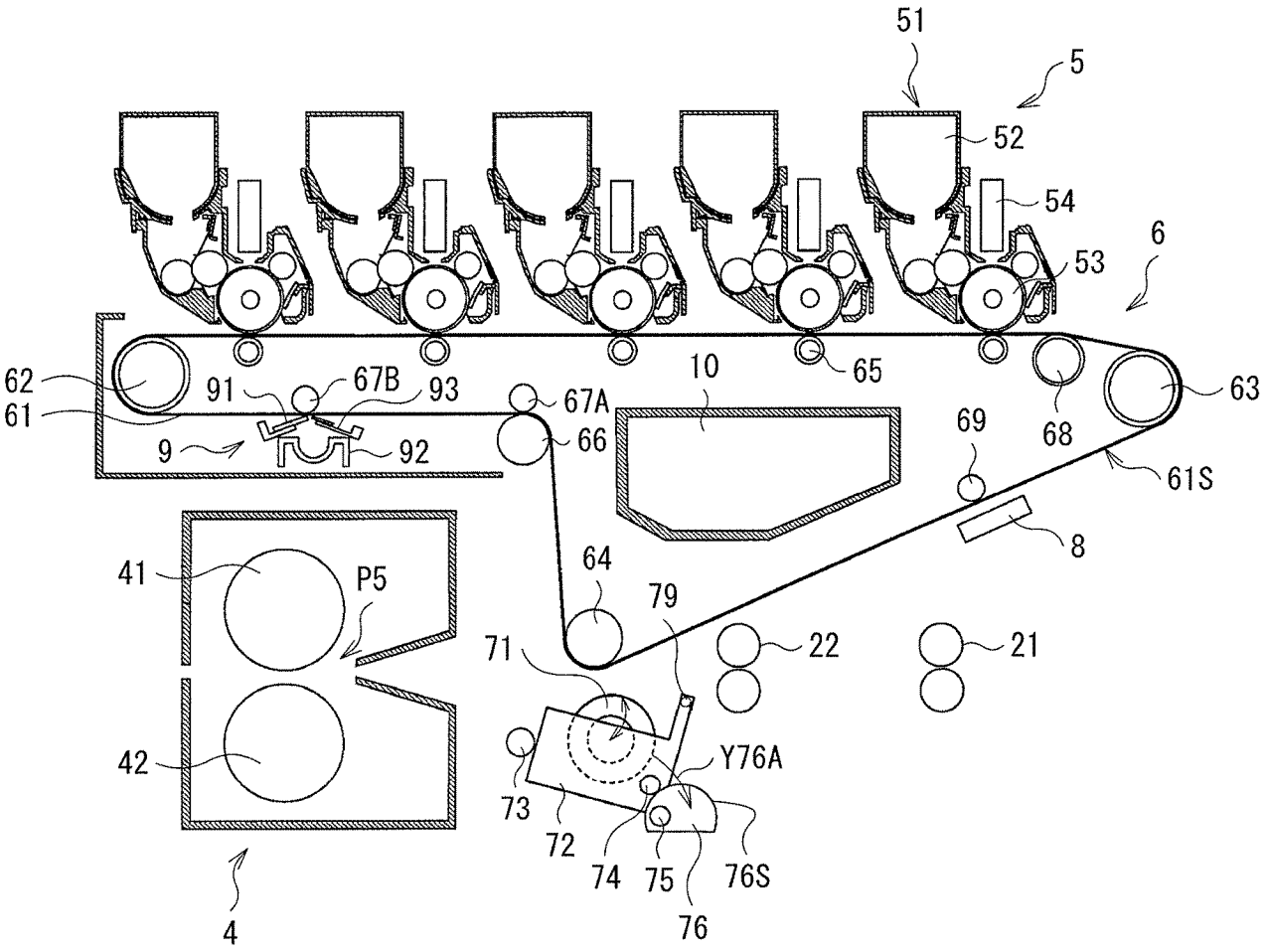
FIG. 6 is another schematic diagram illustrating, upon standby, the overall configuration example of the image forming apparatus illustrated in FIG. 1.

First, a main power supply is turned on to put the image forming apparatus into the standby state (step S1). In the image forming apparatus at this time, the support 72 may be located on lower part, and the secondary transfer roller 71 may be separated away from the intermediate transfer belt 61 as illustrated by way of example in FIG. 6. Further, the roller 41 and the roller 42 of the fixing section 4 may be separated away from each other. FIG. 6 is a diagram illustrating, upon standby before the medium M is inserted, an overall configuration example of the image forming apparatus according to the first embodiment.

Next, a determination is made as to whether to perform density correction and color deviation correction of the toner images (step S2).

When it is determined that these correction operations are necessary (YES in step S2), the density correction and the color deviation correction of the toner images are performed (step S3). At this time, the controller 11 activates the developing devices 51A to 51E and the intermediate transfer belt 61, and a correction toner image may be formed on the transferred surface 61S of the intermediate transfer belt 61. Further, the sensor group 8 detects the correction toner image, and the controller 11 performs the density correction and the color deviation correction of the toner images, on the basis of the detected data.

When a determination is made that the correction operations are unnecessary (NO in step S2), a printing job may be transmitted from an external apparatus or any other apparatus to the controller 11 (step S4).

When receiving the printing job, the controller 11 activates the motor 77, and allows the eccentric cam 76 to pivot to thereby push up the support 72, causing the secondary transfer roller 71 to nip the intermediate transfer belt 61. Further, the controller 11 brings the roller 41 and the roller 42 close to each other, thereby causing them to nip each other (step S5).

Thereafter, the controller 11 activates the developing devices 51A to 51E, the intermediate transfer belt 61, and the fixing section 4 (step S6). As a result, the toner image may be formed on (transferred by means of the primary transfer to) the transferred surface 61S of the intermediate transfer belt 61 through the electrophotography process.

Further, the medium M may be fed out from the roll MR, and the medium conveying section 2 may be activated to feed the medium M to the secondary transferring section. As a result, the toner image on the transferred surface 61S may be transferred (transferred by means of the secondary transfer) to the medium M, and the toner image may be then fixed to the medium M by the fixing section 4 (step S7).

Then, a determination is made as to whether a situation in which the medium M is not properly conveyed, namely, so-called paper jam has occurred in the printing operation (step S8). When it is determined that a paper jam has occurred (YES in step S8), the controller 11 stops the developing devices 51A to 51E, the intermediate transfer belt 61, and the fixing section 4 (step S12). Further, the controller 11 activates the motor 77, and causes the eccentric cam 76 to pivot to thereby move the support 72 downward, separating the secondary transfer roller 71 and the medium M from the intermediate transfer belt 61 and separating the roller 41 and the roller 42 from each other (step S13). Thereafter, the process returns to step S5 after the jammed medium M is removed (step S14).

In contrast, when it is determined that a paper jam has not occurred in the printing operation (NO in step S8), the controller 11 stops the developing devices 51A to 51E, the intermediate transfer belt 61, the fixing section 4, and the medium conveying section 2 (step S9). Then, the controller 11 separates the roller 41 and the roller 42 away from each other. Further, the controller 11 activates the motor 77, and causes the eccentric cam 76 to pivot to thereby move the support 72 downward, separating the secondary transfer roller 71 and the medium M from the intermediate transfer belt 61 (step S10). Thereafter, when the printing operation is to be further performed repeatedly (YES in step S11), the process returns to step S2. If it is determined again that the density correction or any other correction is necessary at this time, the correction operation may be performed again (step S3). In this case, even when the medium M is continuous paper and the medium M remains in the image forming section 3, the correction operation is free from any influence caused by the remaining of the medium M in the image forming section 3, owing to the separation of the medium M away from the intermediate transfer belt 61 by the retaining member 79.

When the printing operation is not to be performed any more in step S10 (NO in step S11), the main power supply may be turned off and the series of operations may be completed (end).

[Effects]

In the image forming apparatus according to the first embodiment, the medium M is separated away from the intermediate transfer belt 61 by the retaining member 79 that is driven by the motor 77, during the operation stop (in standby). Thus, it is possible to perform a correction operation for formation of the developer image on the intermediate transfer belt 61, such as print density correction and the color deviation correction, even when the medium M is located between the intermediate transfer belt 61 and the secondary transfer roller 71. Japanese Unexamined Patent Application Publication No. 2015-25920 mentioned above involves a risk in which the medium may come into contact with an image holding body. In contrast, the present embodiment allows the intermediate transfer belt 61 and the medium M to be separated away from each other with higher possibility, preventing the medium M from being stained by the correction operation. In addition, since the retaining member 79 comes into contact with the upper surface MS of the medium M at the upstream of the secondary transferring section, and pushes down the medium M, it is possible to prevent the toner from being attached to the retaining member 79. If the retaining member 79 is located downstream of the secondary transferring section, the toner of the intermediate transfer belt 61 may possibly be attached to the retaining member 79.

Further, in a case where a so-called paper jam has occurred upon the printing operation, it is possible to ensure that the medium M is separated away from the intermediate transfer belt 61 when drawing out and removing the medium M that remains in the image forming apparatus. This prevents unnecessary interference, friction, and the like between the intermediate transfer belt 61 and the medium M from occurring, making it possible to prevent, for example, generation of any trace on a surface of the intermediate transfer belt 61, and thereby preventing quality of the printed image from being impaired. Further, the roller pair 22, the secondary transferring section, and the fixing section 4 may be arranged in a straight line (so-called straight path is formed). This makes it possible to handle various print media such as special paper.

Further, the driving force derived from the single motor 77 may be used to perform the separating operation that causes the secondary transfer roller 71 to be separated away from the intermediate transfer belt 61 and the separating operation that causes the medium M to be separated away from the intermediate transfer belt 61 in conjunction with each other. This achieves a simplified control operation and a simplified configuration. Further, the support 72 that supports the secondary transfer roller 71 may be integrated with the retaining member 79 that retains the medium M, which achieves a simplifier configuration.

Further, the biasing operation performed on the medium M by the retaining member 79 may be carried out after the holding state of the medium M by the secondary transferring section is released. This makes it possible to reduce a load applied to, for example, the intermediate transfer belt 61 and the medium M. As a result, for example, it is possible to avoid a decrease in quality of printed image.

The image forming apparatus according to one embodiment of the invention therefore makes it possible to form an image with better quality.

[2. Modification of First Embodiment]

Figure 7:
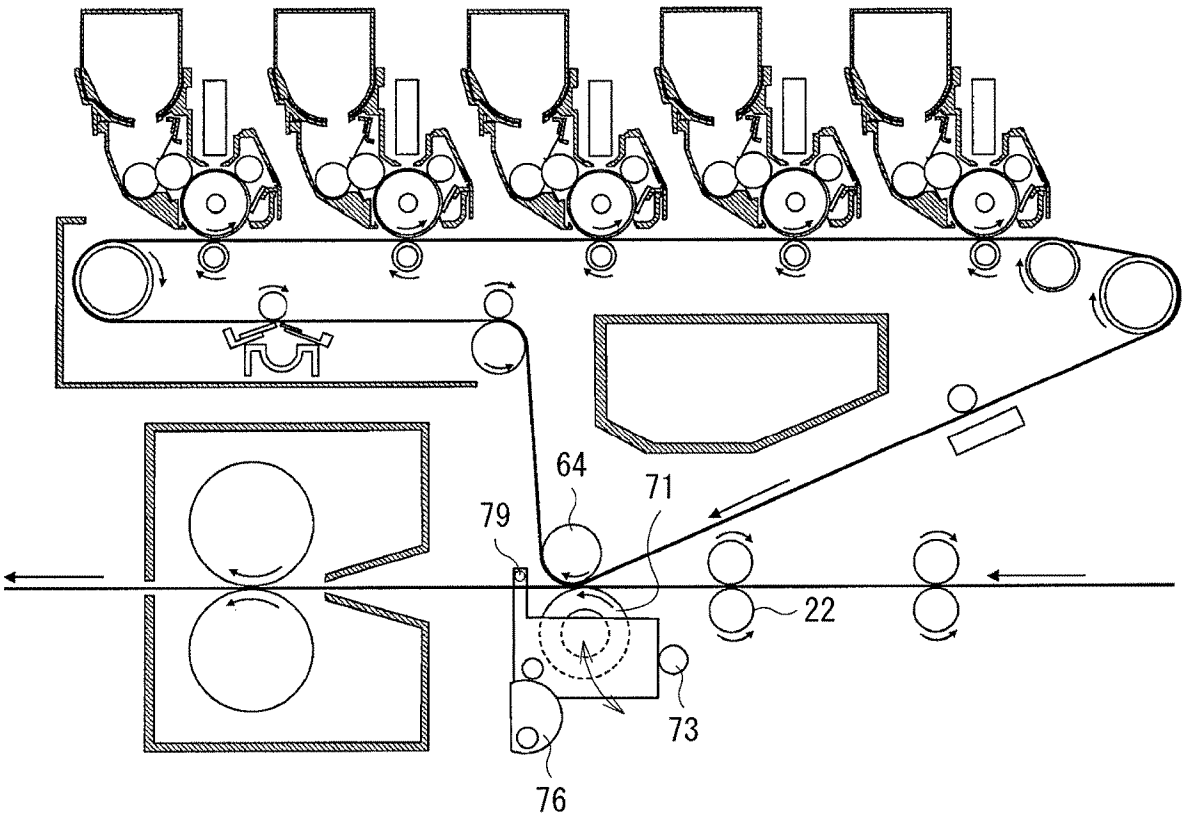
FIG. 7 is a schematic diagram illustrating an overall configuration example of an image forming apparatus according to a modification of the first embodiment of the invention.

FIG. 7 is a schematic diagram illustrating an overall configuration example of an image forming apparatus according to a modification of the first embodiment of the invention. The present modification has a configuration the same as that of the image forming apparatus according to the above-described first embodiment, except that the retaining member 79 is provided downstream of the secondary transferring section in which the secondary transfer backup roller 64 and the secondary transfer roller 71 face each other.

The configuration according to the present modification may be employed in a case where it is difficult to dispose the retaining member 79 between the roller pair 22 and the secondary transferring section due to restrictions on the configuration. For example, the configuration may be employed when a distance between the roller pair 22 and the secondary transferring section is narrow.

[3. Second Embodiment]

[Outline Configuration]

Figure 8A:
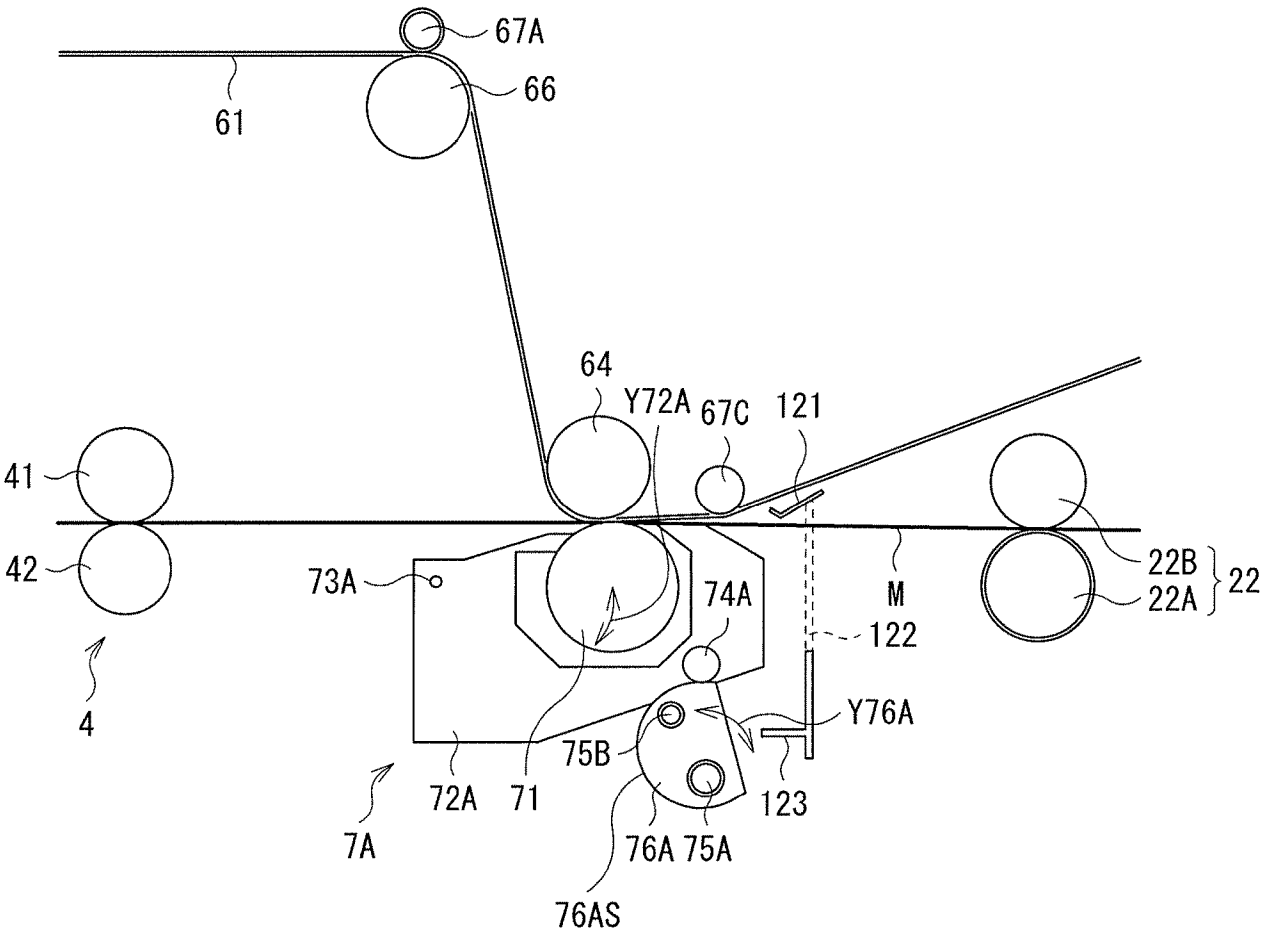
FIG. 8A is a schematic diagram illustrating, upon printing operation, a configuration example of a key part of an image forming apparatus according to a second embodiment of the invention.
Figure 8B:
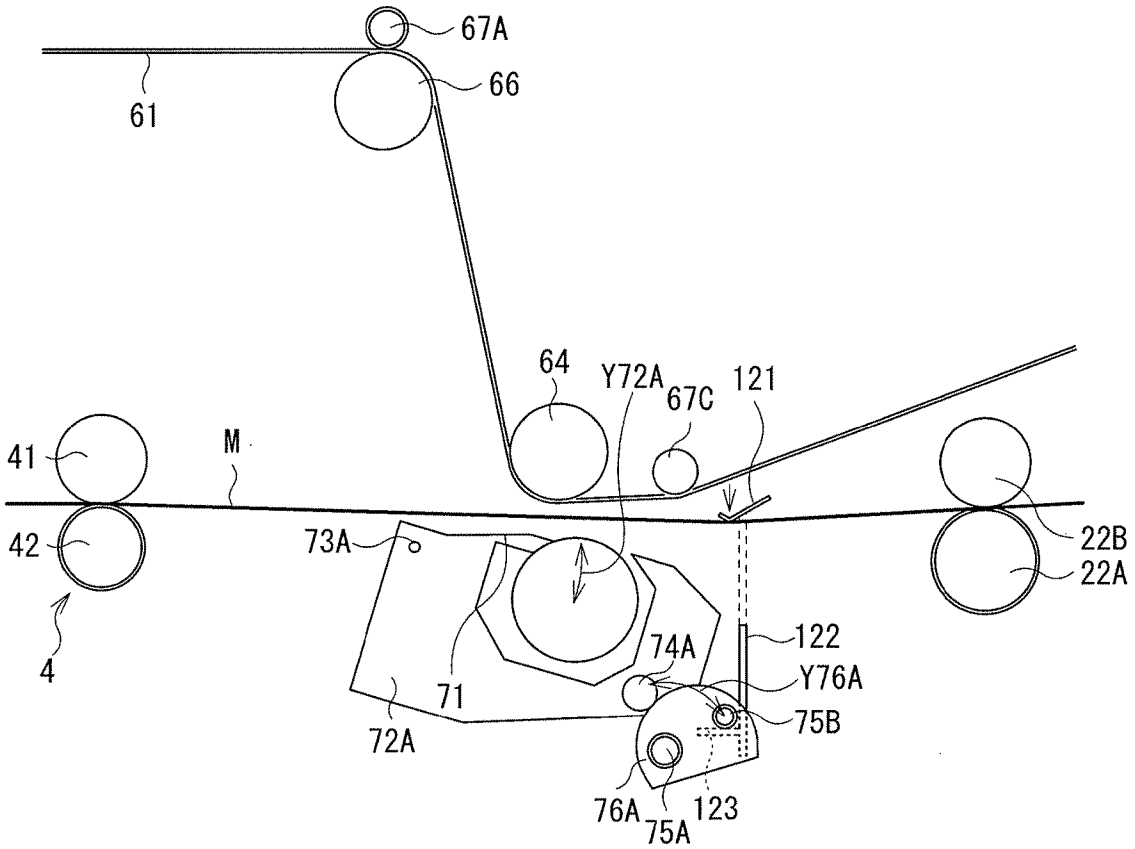
FIG. 8B is a schematic diagram illustrating, upon standby, a configuration example of the key part of the image forming apparatus illustrated in FIG. 8A.

FIG. 8A is a schematic diagram illustrating, upon the printing operation, a configuration example of a key part of an image forming apparatus according to a second embodiment of the invention. FIG. 8B is a schematic diagram illustrating, upon standby, a configuration example of the key part of the image forming apparatus according to the second embodiment of the invention. The image forming apparatus has a configuration substantially similar to that of the image forming apparatus according to the first embodiment, except that a secondary transfer roller unit 7A is provided in place of the secondary transfer roller unit 7, and a retaining member 12 (See FIG. 12) that retains the medium M is provided separately from the secondary transfer roller unit 7A. In the following, a description is mainly given on the retaining member 12 and any component around the retaining member 12, and other components are denoted with reference numerals similar to those of the first embodiment and the description thereof is omitted where appropriate. Note that, in FIG. 8A and FIG. 8B, only key components are illustrated and other components are not illustrated.

As illustrated in FIG. 8A and FIG. 8B, the intermediate transfer unit 6 of the image forming apparatus further includes a support roller 67C that is provided near the upstream side of the secondary transfer backup roller 64. The support roller 67C stretches the intermediate transfer belt 61. Providing the support roller 67C makes it possible to bring the intermediate transfer belt 61 between the secondary transfer backup roller 64 and the support roller 67C, closer to the medium M that is conveyed through the roller pair 22 and the secondary transferring section. More specifically, providing the support roller 67C allows the intermediate transfer belt 61 to so travel as to be substantially parallel even more to the medium M that is about to go into the secondary transferring section. Hence, it is possible to expect an improvement in print quality of the toner image that is transferred to the medium M.

[Detailed Configuration of Secondary Transfer Roller Unit 7A and Retaining Member 12]

Figure 9:
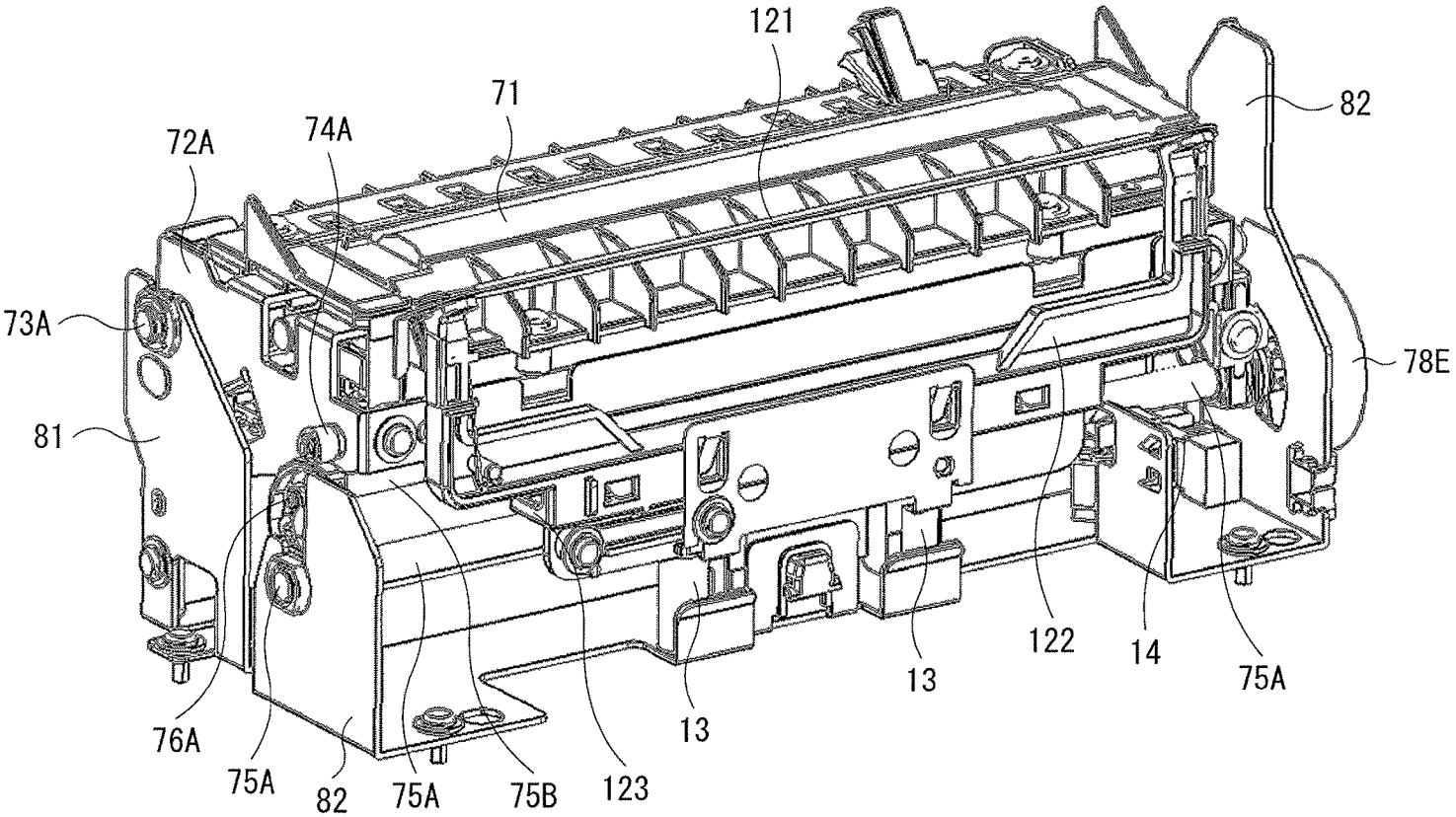
FIG. 9 is a perspective view of a secondary transfer roller unit and a retaining member in the image forming apparatus illustrated in FIG. 8A.
Figure 10:
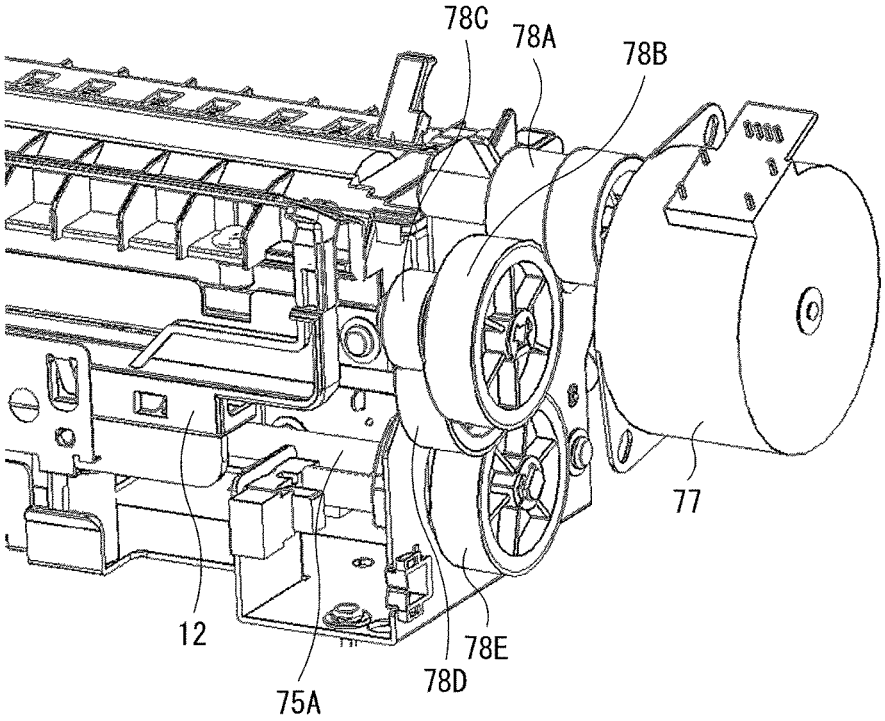
FIG. 10 is a perspective view of a part of the secondary transfer roller unit and the retaining member in the image forming apparatus illustrated in FIG. 8A.
Figure 11:
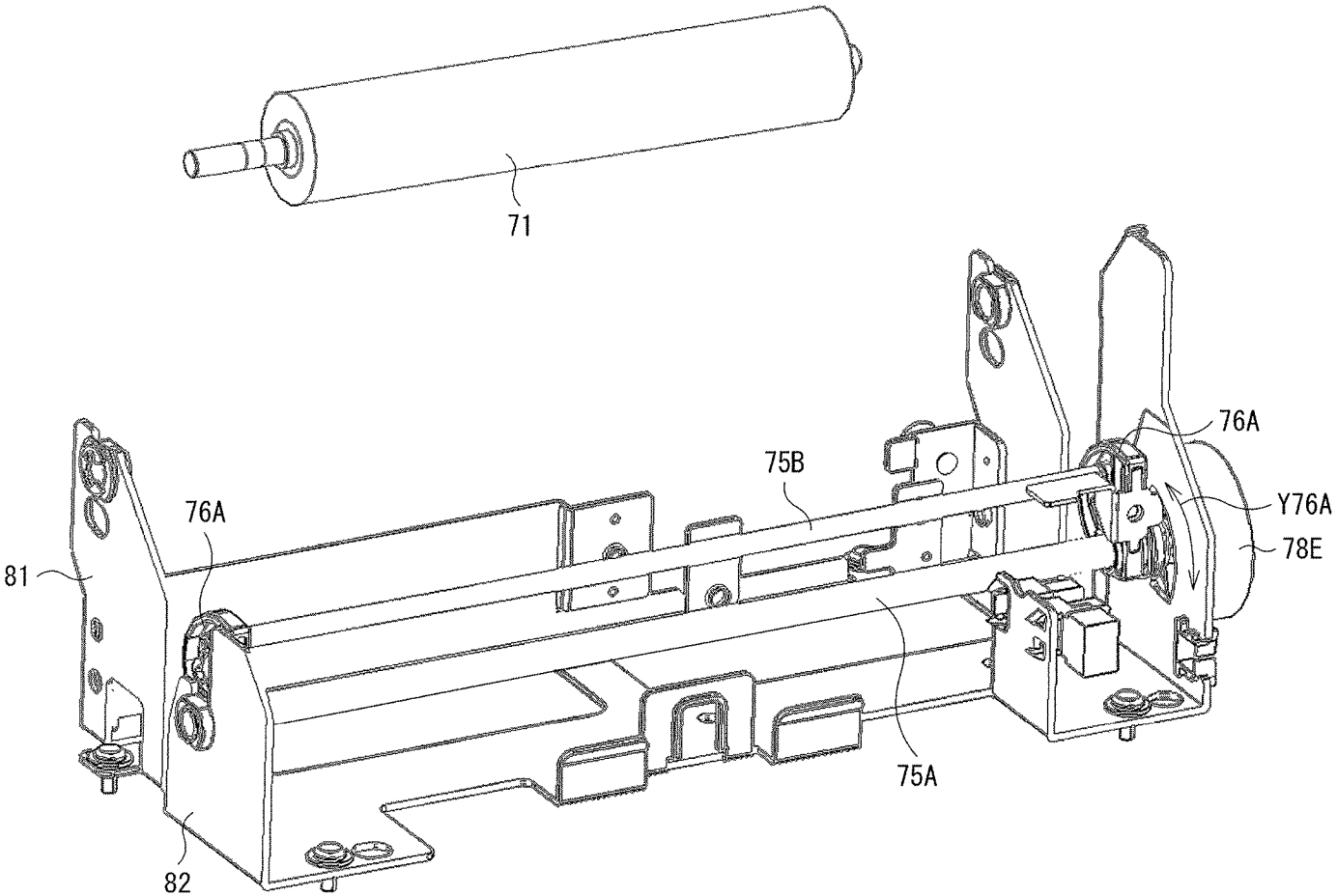
FIG. 11 is an exploded perspective view of a part of the secondary transfer roller unit and the retaining member in the image forming apparatus illustrated in FIG. 8A.
Figure 12:
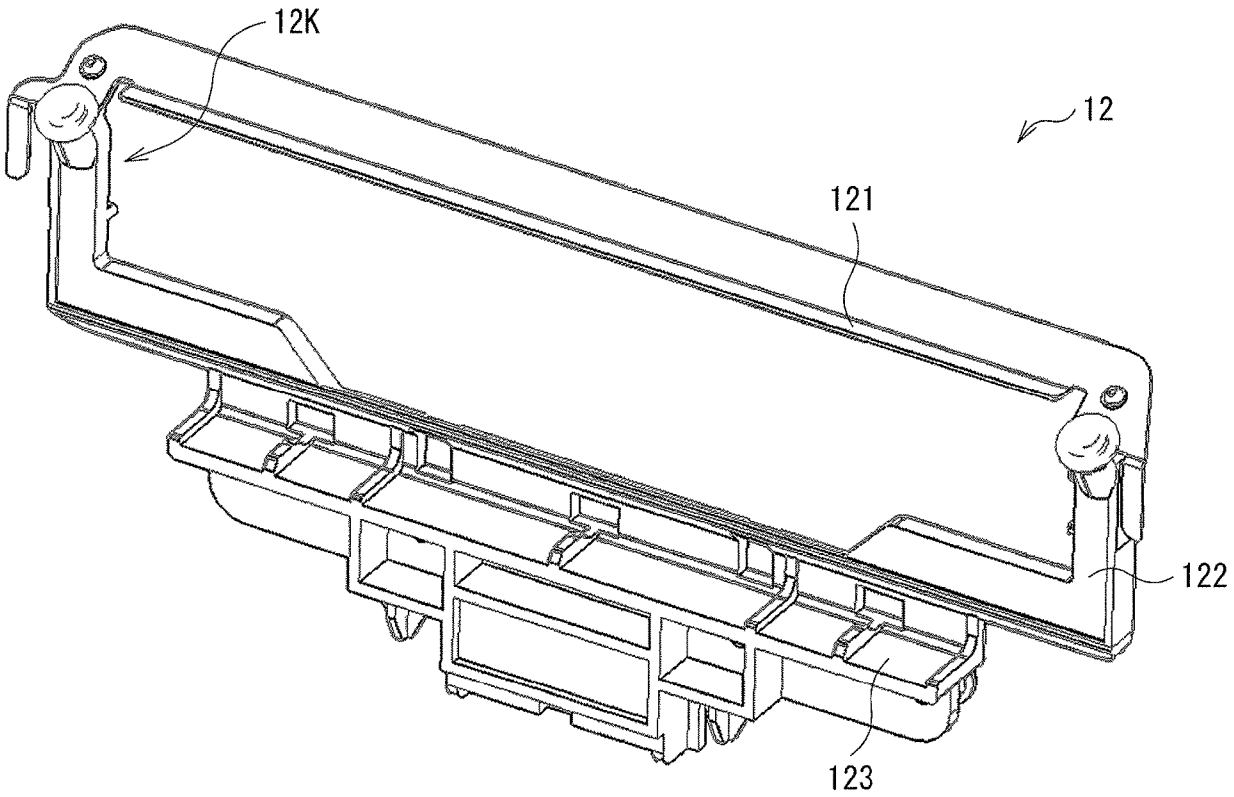
FIG. 12 is a perspective view of the retaining member in the image forming apparatus illustrated in FIG. 8A.

The configurations of the secondary transfer roller unit 7A and the retaining member 12 are described in more detail with reference to FIG. 9 to FIG. 12 in addition to FIG. 8A and FIG. 8B. FIG. 9 is a perspective view of the secondary transfer roller unit 7A and the retaining member 12. FIG. 10 is a perspective view of a part of the secondary transfer roller unit 7A and the retaining member 12. FIG. 11 is an exploded perspective view of a part of the secondary transfer roller unit 7A. FIG. 12 is a perspective view of the retaining member 12.

The secondary transfer roller unit 7A has a configuration substantially similar to that of the secondary transfer roller unit 7 according to the above-described first embodiment, except that the secondary transfer roller unit 7A includes a support 72A that rotatably supports the secondary transfer roller 71, shaft members 73A to 75A and 75B, and an eccentric cam 76A. The driving force of the motor 77 may be transmitted to the shaft member 75A through the gears 78A to 78E (see FIG. 10).

Also, two eccentric cams 76A may be so provided as to sandwich the support 72A in the lateral direction. The two eccentric cams 76A may be coupled to each other through the two shaft members 75A and 75B that extend in the lateral direction. The support 72A may be so held by a frame 81 that is fixed to the image forming apparatus main body, as to be pivotable with the shaft member 73A as a supporting point. Each of the eccentric cams 76A may be so held by a frame 82 that is fixed to the image forming apparatus main body, as to be pivotable around the shaft member 75A. Therefore, when the shaft member 74A slides on a peripheral surface 76AS of the eccentric cam 76A, the support 72A may pivot around the shaft member 73A, for example, within a range of an arrow Y72A, thereby moving in the vertical direction. This allows the secondary transfer roller 71 to make a transition between the biasing state and the separated state. Note that FIG. 8A illustrates the biasing state in which the secondary transfer roller 71 biases the intermediate transfer belt 61 toward the secondary transfer backup roller 64, and FIG. 8B illustrates the separated state in which the secondary transfer roller 71 is separated away from the intermediate transfer belt 61.

The retaining member 12 includes a retaining part 121, a supporting part 122, and a cam receiving part 123 (for example, see FIG. 12). The retaining part 121 extends in the lateral direction, and comes into contact with the medium M upon the separating operation of the medium M. The retaining part 121 may have a substantially V-shaped cross section orthogonal to the lateral direction, for example (FIG. 1). The supporting part 122 supports the retaining part 121 from below, and forms an opening 12K through which the medium M passes, together with the retaining part 121. The cam receiving part 123 may be a protrusion that is installed upright on the supporting part 122 and extends in the lateral direction. The cam receiving part 123 comes into contact with the shaft member 75B that is fixed to the eccentric cam 76A, to receive downward biasing force, when the medium M is to be separated away from the intermediate transfer belt 61. In contrast, upon the printing operation illustrated in FIG. 8A, the cam receiving part 123 may be separated away from the shaft member 75B. The retaining member 12 may be held by, for example, the frame 82 to be movable in the vertical direction. Further, a biasing member 13 such as a plate spring and a coil spring may be provided below the supporting part 122. The retaining member 12 may be biased upward by biasing force of the biasing member 13. Therefore, upon the printing operation illustrated in FIG. 8A, the cam receiving part 123 does not receive the biasing force from the shaft member 75B. The retaining part 121 accordingly receives only the biasing force of the biasing member 13 through the cam receiving part 123 and the supporting part 122, thereby maintaining the separated state from the medium M. Therefore, in the biasing state, the secondary transfer roller 71 may be separated away from the intermediate transfer belt 61 at timing different from timing at which the medium M may be separated away from the intermediate transfer belt 61. In detail, at the time immediately after the support 72A starts to change its attitude (to move from the state in FIG. 8A to the state in FIG. 8B), the holding state of the medium M by the secondary transfer roller 71 and the intermediate transfer belt 61 may be released but the biasing operation of the retaining part 121 with respect to the medium M has not been started. This is due to a gap provided between the retaining part 121 and the medium M, and a predetermined time is thus necessary for the retaining part 121 to come close to and come into contact with the medium M. In other words, when the retaining part 121 is to be separated from the medium M in the biasing state, the retaining part 121 starts to separate the medium M away from the intermediate transfer belt 61 after the secondary transfer roller 71 starts making a transition from the biasing state to the separated state.

[Operation]

Upon the printing operation, the medium M may be held, together with the intermediate transfer belt 61, between the secondary transfer backup roller 64 and the secondary transfer roller 71 in the secondary transferring section, and the retaining member 12 may be retracted to a position separated from the medium M (FIG. 8A), as with the image forming apparatus according to the foregoing first embodiment. As illustrated by way of example in FIG. 8A, the eccentric cam 76A pivots leftward within a range of an arrow Y76A. Further, the part that is located relatively far from the shaft member 75A, of the peripheral surface 76AS of the eccentric cam 76A may come into contact with the shaft member 74A, and the support 72A may be pushed up to a high position relatively. This puts the secondary transfer roller 71 into the biasing state, and the medium M may be accordingly nipped by the secondary transferring section. At this time, since the shaft member 75B is separated away from the cam receiving part 123, the retaining member 12 may be pushed upward by the biasing force of the biasing member 13, and may be retracted to the position separated from the medium M. Thus, it is possible to prevent an occurrence of a situation where the retaining member 12 damages the conveyed medium M or the retaining member 12 inhibits conveying of the medium M.

Upon the standby, the medium M may be retracted to a position separated from the intermediate transfer belt 61 by the retaining member 12, and the secondary transfer roller 71 may also be retracted to a position separated from the intermediate transfer belt 61. At this time, the medium M may be separated also from the secondary transfer roller 71. More specifically, as illustrated by way of example in FIG. 8B, the eccentric cam 76A may make a transition to a position that is rotated rightward within the range (for example, 90 degrees) of the arrow Y76A from the position in FIG. 8A. This brings a part that is located relatively close to the shaft member 75A, of the peripheral surface 76AS of the eccentric cam 76A into contact with the shaft member 74A, thereby putting the support 72A into the separated state in which the support 72A is dropped down to a low position relatively. Further, the shaft member 75B comes into contact with the cam receiving part 123 to bias the cam receiving part 123 downward. As a result, the retaining part 121 also moves downward to bias the medium M downward, and the medium M may be separated away from the intermediate transfer belt 61 accordingly.

The series of operations described above may be controlled by the controller 11, as with the above-described first embodiment. Note that the pivot position of the eccentric cam 76A may be detected by a position sensor 14 (FIG. 9) such as an optical sensor.

The foregoing second embodiment also makes it possible to achieve effects similar to those of the above-described first embodiment. Since the support 72A that supports the secondary transfer roller 71 and the retaining member 12 that retains the medium M are provided separately from each other, flexibility in design relating to arrangement of the support 72A and the retaining member 12 is increased as compared with the first embodiment in which the support and the retaining member are integrated. Further, the retaining member 12 may be forcibly brought into contact with the medium M by the eccentric cam 76A by means of the driving force derived from the motor 77. Therefore, it is possible to ensure that the medium M is separated away from the intermediate transfer belt 61 even when the medium M is large in thickness or high in hardness. Further, providing the support 72A and the retaining member 12 separately from each other makes it possible to individually set the retracted positions upon the standby of the secondary transfer roller 71 and the medium M. This makes it possible to ensure that the contact between the secondary transfer roller 71 and the medium M is prevented. Further, a load applied to the secondary transfer roller 71 is reduced, and allowing for expectation for longer life of the secondary transfer roller 71. Moreover, the intermediate transfer belt 61 is separated away from the medium M during the operation stop (upon the standby), allowing for detachment of the intermediate transfer unit 6. This facilitates a replacement operation of the intermediate transfer unit 6 attributable to the deterioration of the intermediate transfer belt 61 or any other component.

Further, the biasing operation performed on the medium M by the retaining part 121 may be carried out after the holding state of the medium M by the secondary transferring section is released. This makes it possible to reduce a load applied to, for example, the intermediate transfer belt 61 and the medium M. As a result, for example, it is possible to avoid a decrease in quality of printed image.

[4. Modification of Second Embodiment]

Figure 13A:
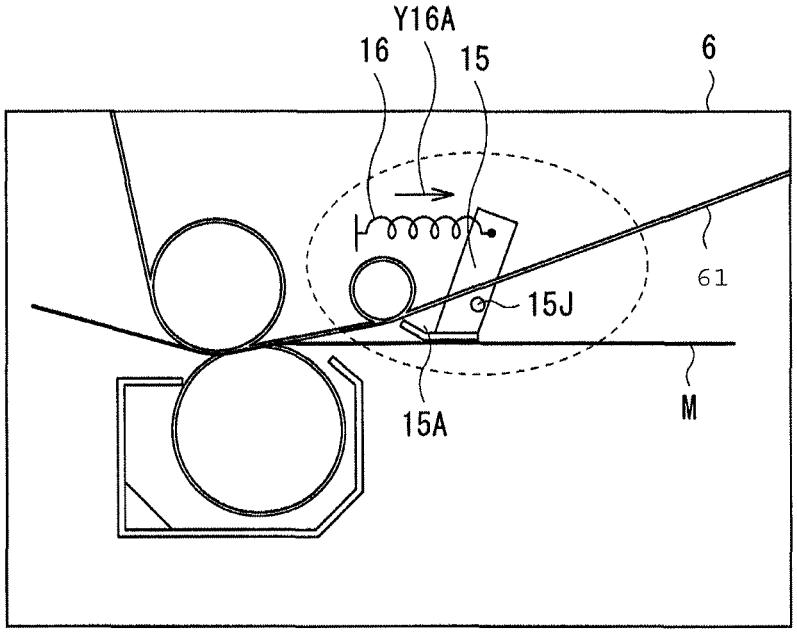
FIG. 13A is a schematic diagram illustrating, upon printing operation, an overall configuration example of an image forming apparatus according to a modification of the second embodiment of the invention.
Figure 13B:
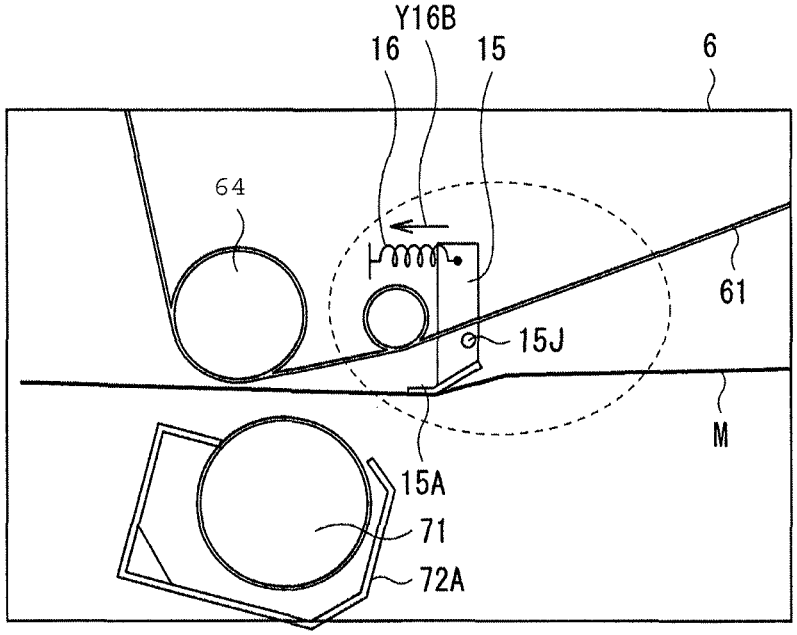
FIG. 13B is a schematic diagram illustrating, upon standby, the overall configuration example of the image forming apparatus illustrated in FIG. 13A.

FIG. 13A and FIG. 13B each schematically illustrate a configuration example of a key part of an image forming apparatus according to a modification of the second embodiment of the invention. The present modification has a configuration the same as that of the image for apparatus according to the above-described second embodiment, except that a retaining member 15 fixed to the intermediate transfer unit 6 is provided in place of the retaining member 12.

The retaining member 15 may be so fixed to a main body of the intermediate transfer unit 6 as to be rotatable around a shaft 15J. The retaining member 15 has a retaining part 15A at a front end thereof. The retaining part 15A may be retracted to a position separated from the medium M upon the printing operation (FIG. 13A), and the retaining part 15A biases the medium M downward (in a direction in which the medium M is separated away from the intermediate transfer belt 61) upon the standby (FIG. 13B). More specifically, a coil spring 16 serving as a biasing member may be provided at a location that is in the vicinity of an end, of the retaining member 15, on the opposite side of the retaining part 15A. Upon the standby illustrated in FIG. 13B, the retaining member 15 may be pulled by biasing force of the coil spring 16 in a direction of an arrow Y16B, which causes the retaining part 15A to bias the medium M downward. In contrast, upon the printing operation illustrated in FIG. 13A, driving force derived from the motor or any other component may be transmitted to the retaining member 15 through the shaft 15J, which causes the retaining member 15 to rotate around the shaft 15J in a direction of an arrow Y16A that is a direction against the biasing force of the coil spring 16 (in a direction in which the coil spring 16 is extended). As a result, the retaining part 15A is retracted to a position separated from the medium M.

The configuration according to the present modification may be employed in a case where there are restrictions on the configuration. For example, the configuration may be employed when sufficient space is not secured around the secondary transfer roller unit 7A.

[5. Other Modifications]

Although the invention has been described with some example embodiments and modifications thereof, the invention is not limited to the example embodiments and the modifications, and may be variously modified.

For example, a description has been given in the above-described example embodiments and modifications of the image forming apparatus that fouls a color image. The invention, however, is not limited thereto. Alternatively, the image forming apparatus may transfer only a toner image of a black color to thereby form a monochrome image.

For example, the support 72 is moved downward by own weight in the above-described first embodiment. Alternatively, for example, the support 72 may be forcibly moved downward by a biasing member such as a coil spring. Further alternatively, the support 72 may be forcibly moved upward by a biasing member such as a coil spring, and the support 72 may be forcibly moved downward by the eccentric cam 76.

A description has been given in the above-described example embodiments and modifications of the image forming apparatus that has a printing function, as a specific but non-limiting example of an "image forming apparatus" in one embodiment of the invention. The image forming apparatus, however, is not limited thereto. Any embodiment of the invention is applicable to an image forming unit that functions as a multifunctional peripheral having a function such as a scanner function, a facsimile function, and an image displaying function, in addition to the printing function.

Furthermore, the invention encompasses any possible combination of some or all of the various embodiments and the modifications described herein and incorporated herein.

It is possible to achieve at least the following configurations from the above-described example embodiments of the invention.

(1) An image forming apparatus, including:

an image forming section that forms a developer image;

a transferred member conveyed in a first direction and onto which the developer image is to be transferred;

a transfer roller that faces the transferred member, and makes a transition between a biasing state in which the transferred member is biased by the transfer roller and a separated state in which the transfer roller is separated away from the transferred member; and a separator starts to separate a medium away from the transferred member after the transfer roller starts making a transition from the biasing state to the separated state, the medium being held between the transferred member and the transfer roller in the biasing state.

(2) The image forming apparatus according to (1), wherein the separator includes:

a driver; and a biasing member that biases the medium in a direction in which the medium is separated away from the transferred member, by one of driving force transmitted from the driver and free fall of the biasing member.

(3) The image forming apparatus according to (2), wherein the biasing member is separated away from the medium in the biasing state.

(4) The image forming apparatus according to (2), wherein the transfer roller performs an approaching operation in which the transfer roller comes close to the transferred member and a separating operation in which the transfer roller is separated away from the transferred member.

(5) The image forming apparatus according to (4), wherein the separating operation of the transfer roller and a separating operation in which the medium is separated away from the transferred member are performed in conjunction with each other.

(6) The image forming apparatus according to (5), further including a support that supports the transfer roller, wherein the biasing member is fixed to the support, and both the transfer roller and the medium are separated away from the transferred member by a movement of the support.

(7) The image foiniing apparatus (2), wherein a separating operation in which the transfer roller is separated away from the transferred member and a separating operation in which the medium is separated away from the transferred member are performed by the driving force transmitted from the driver.

(8) The image forming apparatus according to (2), further including:

a support that supports the transfer roller; and a cam that receives the driving force transmitted from the driver and comes into contact with the support, wherein the cam pivots in a first pivoting direction by the driving force transmitted from the driver, and thereby biases the support and brings the transfer roller close to the transferred member.

(9) The image forming apparatus according to (8), wherein the cam pivots in the first pivoting direction and thereby separates the biasing member away from the medium, and pivots in a second pivoting direction that is opposite to the first pivoting direction, and thereby moves the biasing member and separates the medium away from the transferred member.

(10) The image forming apparatus (2), wherein the biasing member is disposed at a position upstream of a transferring section in which the transfer roller and the transferred member face each other, and comes into contact with the medium at the position upstream of the transferring section.

(11) The image forming apparatus according to (1), further including:

a first roller pair disposed upstream of a transferring section in which the transfer roller and the transferred member face each other; and a second roller pair disposed downstream of the transferring section, wherein the first roller pair, the transferring section, and the second roller pair are arranged in a straight line.

(12) An image forming apparatus, including:

an image forming section that forms a developer image;

a transferred member conveyed in a first direction and onto which the developer image is to be transferred;

a transfer roller that faces the transferred member, and makes a transition between a biasing state in which the transferred member is biased by the transfer roller and a separated state in which the transfer roller is separated away from the transferred member;

a support that supports the transfer roller; and a separator that starts to separate a medium away from the transferred member after the transfer roller starts making a transition from the biasing state to the separated state, the medium being held between the transferred member and the transfer roller in the biasing state, wherein the separator includes a driver, a cam, and a biasing member, the cam pivoting, by driving force transmitted from the driver, in one of a first pivoting direction and a second pivoting direction that is opposite to the first pivoting direction, and the biasing member biasing, by the pivot of the cam in the second pivoting direction, the medium in a direction in which the medium is separated away from the transferred member, and the support brings the transfer roller close to the transferred member by the pivot of the cam in the first pivoting direction, or separates the transfer roller away from the transferred member by the pivot of the cam in the second pivoting direction, Although the invention has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus, comprising:

an image forming section that forms a developer image;

a transferred member conveyed in a first direction and onto which the developer image is to be transferred;

a transfer roller that faces the transferred member, and makes a transition between a biasing state in which the transferred member is biased by the transfer roller and a separated state in which the transfer roller is separated away from the transferred member; and a separator that, starts to separate a medium away from the transferred member after the transfer roller starts making a transition from the biasing state to the separated state, the medium being held between the transferred member and the transfer roller in the biasing state.

2. The image forming apparatus according to claim 1, wherein the separator includes:

a driver; and a biasing member that biases the medium in a direction in which the medium is separated away from the transferred member, by one of driving force transmitted from the driver and free fall of the biasing member.

3. The image forming apparatus according to claim 2, wherein the biasing member is separated away from the medium in the biasing state.

4. The image forming apparatus according to claim 2, wherein the transfer roller performs an approaching operation in which the transfer roller comes close to the transferred member and a separating operation in which the transfer roller is separated away from the transferred member.

5. The image forming apparatus according to claim 4, wherein the separating operation of the transfer roller and a separating operation in which the medium is separated away from the transferred member are performed in conjunction with each other.

6. The image forming apparatus according to claim 5, further comprising a support that supports the transfer roller, wherein the biasing member is fixed to the support, and both the transfer roller and the medium are separated away from the transferred member by a movement of the support.

7. The image forming apparatus according to claim 2, wherein a separating operation in which the transfer roller is separated away from the transferred member and a separating operation in which the medium is separated away from the transferred member are performed by the driving force transmitted from the driver.

8. The image forming apparatus according to claim 2, further comprising:

a support that supports the transfer roller; and a cam that receives the driving force transmitted from the driver and comes into contact with the support, wherein the cam pivots in a first pivoting direction by the driving force transmitted from the driver, and thereby biases the support and brings the transfer roller close to the transferred member.

9. The image forming apparatus according to claim 8, wherein the cam pivots in the first pivoting direction and thereby separates the biasing member away from the medium, and pivots in a second pivoting direction that is opposite to the first pivoting direction, and thereby moves the biasing member and separates the medium away from the transferred member.

10. The image forming apparatus according to claim 2, wherein the biasing member is disposed at a position upstream of a transferring section in which the transfer roller and the transferred member face each other, and comes into contact with the medium at the position upstream of the transferring section.

11. The image forming apparatus according to claim 1, further comprising:

a first roller pair disposed upstream of a transferring section in which the transfer roller and the transferred member face each other; and a second roller pair disposed downstream of the transferring section, wherein the first roller pair, the transferring section, and the second roller pair are arranged in a straight line.

12. An image forming apparatus, comprising:

an image forming section that forms a developer image;

a transferred member conveyed in a first direction and onto which the developer image is to be transferred;

a transfer roller that faces the transferred member, and makes a transition between a biasing state in which the transferred member is biased by the transfer roller and a separated state in which the transfer roller is separated away from the transferred member;

a support that supports the transfer roller; and a separator, starts to separate a medium away from the transferred member after the transfer roller starts to making a transition from the biasing state to the separated state, the medium being held between the transferred member and the transfer roller in the biasing state, wherein the separator includes a driver, a cam, and a biasing member, the cam pivoting, by driving force transmitted from the driver, in one of a first pivoting direction and a second pivoting direction that is opposite to the first pivoting direction, and the biasing member biasing, by the pivot of the cam in the second pivoting direction, the medium in a direction in which the medium is separated away from the transferred member, and the support brings the transfer roller close to the transferred member by the pivot of the cam in the first pivoting direction, or separates the transfer roller away from the transferred member by the pivot of the cam in the second pivoting direction.

* * * * *